US007066636B2

(12) United States Patent
Wu

(10) Patent No.: US 7,066,636 B2
(45) Date of Patent: Jun. 27, 2006

(54) ORNAMENTAL LAMP STRINGS ASSEMBLY

(76) Inventor: Jeng-shyong Wu, No. 14, Alley 1, Lane 326, Shin-Pin Road, Hsinchu (TW)

( * ) Notice: Subject to any disclaimer, the term of this patent is extended or adjusted under 35 U.S.C. 154(b) by 59 days.

(21) Appl. No.: 10/920,918

(22) Filed: Aug. 18, 2004

(65) Prior Publication Data

US 2006/0039144 A1 Feb. 23, 2006

(51) Int. Cl.
*F21V 33/00* (2006.01)

(52) U.S. Cl. ..... 362/654; 362/252; 362/249; 362/235; 362/806

(58) Field of Classification Search ..... 362/654, 362/640, 252, 249, 124, 292, 297, 235, 806, 362/812, 257, 236, 301, 330, 339, 346
See application file for complete search history.

(56) References Cited

U.S. PATENT DOCUMENTS

| | | | | |
|---|---|---|---|---|
| 5,379,202 | A * | 1/1995 | Daun | 362/252 |
| 6,217,192 | B1 * | 4/2001 | Stratton | 362/249 |
| 6,598,995 | B1 * | 7/2003 | Huang | 362/249 |
| 6,854,863 | B1 * | 2/2005 | Wu | 362/292 |

* cited by examiner

*Primary Examiner*—Laura K. Tso
(74) *Attorney, Agent, or Firm*—McGlow & Tuttle, P.C.

(57) ABSTRACT

An ornamental lamp strings assembly is disclosed. It comprises a plurality of lamp strings each unit in one string being composed of an electric conductor, a lamp socket, a lamp holder and a lighting element, and the lamp socket is provided with a slanted support; and a base plate having a drilled hole for fastening to the slanted support of the lamp socket with its inner fringe. With this scheme, each lamp socket is slantly erected on the base plate forming an acute angle with the base plate.

72 Claims, 19 Drawing Sheets

ORNAMENTAL LAMP STRINGS ASSEMBLY

BACKGROUND OF THE INVENTION

1. Field of the Invention

The present invention relates to an ornamental lamp strings assembly, and more particularly, its individual light source is slantly sustained on a base plate with a plurality of set blocks disposed in various positions so as to configurate the whole lamp strings assembly into a variety of contours capable of exhibiting a dexterously ornamental effect.

2. Description of the Prior Art

Like the marching for celebration, especially in the evening of Chinese lantern festival day, there has often appeared exhibition of an ornamental lighting effect with many interesting animal styles such as tiger, horse, leopard . . . etc. For this, brilliant light source is required.

For constructing a stream of ornamental lamp strings in various figure. The individual light source is generally sustained vertically on a base plate in the manner by providing a circular or any other shaped drilled hole for insertion of the lamp socket and fastening the lamp by engaging the flange of the lamp socket with the packing provided around the inner fringe of the drilled hole opened on the base plate.

In this case, the contour of the lamp strings assembly will be too monotonous because all the lamps are erected vertically on their bases, unless some modifications are made to the bases, a satisfactory ornamental effect can not be realized.

Alternatively, in a most common prior practice, a plurality of supporting frames are arranged in a predetermined figure so as to allow the lamps fastened on them to exhibit an ornamental effect. However, the lamp strings assembly constructed in this manner is apt to get loose and needs a long time to install, while only applicable for static exhibition.

For these defects noticeable on the prior art, an improvement is seriously required.

The inventor has dedicated great efforts for years to studying and improving these defects and come up with a novel ornamental lamp string assembly as provided in this invention to eliminate the defects mentioned above.

SUMMARY OF THE INVENTION

The main object of the present invention is to provide an ornamental lamp strings assembly whose plurality of lamp strings comprise a plurality of electric conductors, lamps and lamp sockets and holders, the individual lamp is slantly fastened on its base plate by inserting the lamp socket into the drilled hole provided on the base pate and engaging the slanted support of the lamp socket with the inner fringe of the drilled hole such that the lamp is fixed to the base plate slantly with an acute angle with respect to the longitudinal direction of the lamp string.

Another object of the present invention is to provide an ornamental lamp strings assembly in which the lamp socket is slantly fastened to the drilled hole of its base plate by a plurality of set blocks from two opposite directions with respect to the longitudinal direction of the lamp string.

Still another object of the present invention is to provide an ornamental lamp strings assembly in which the lamp is slantly fastened to its base plate or a specially configurated plate made of a transparent or semi-transparent, similar or different colored material so as to further enhance the ornamental lighting effect.

The above objects and other advantages of the present invention will become more apparent by describing in detail the preferred embodiments of the present invention with reference to the attached drawings.

DETAILED DESCRIPTION OF THE PREFERRED EMBODIMENTS

Figure 1:
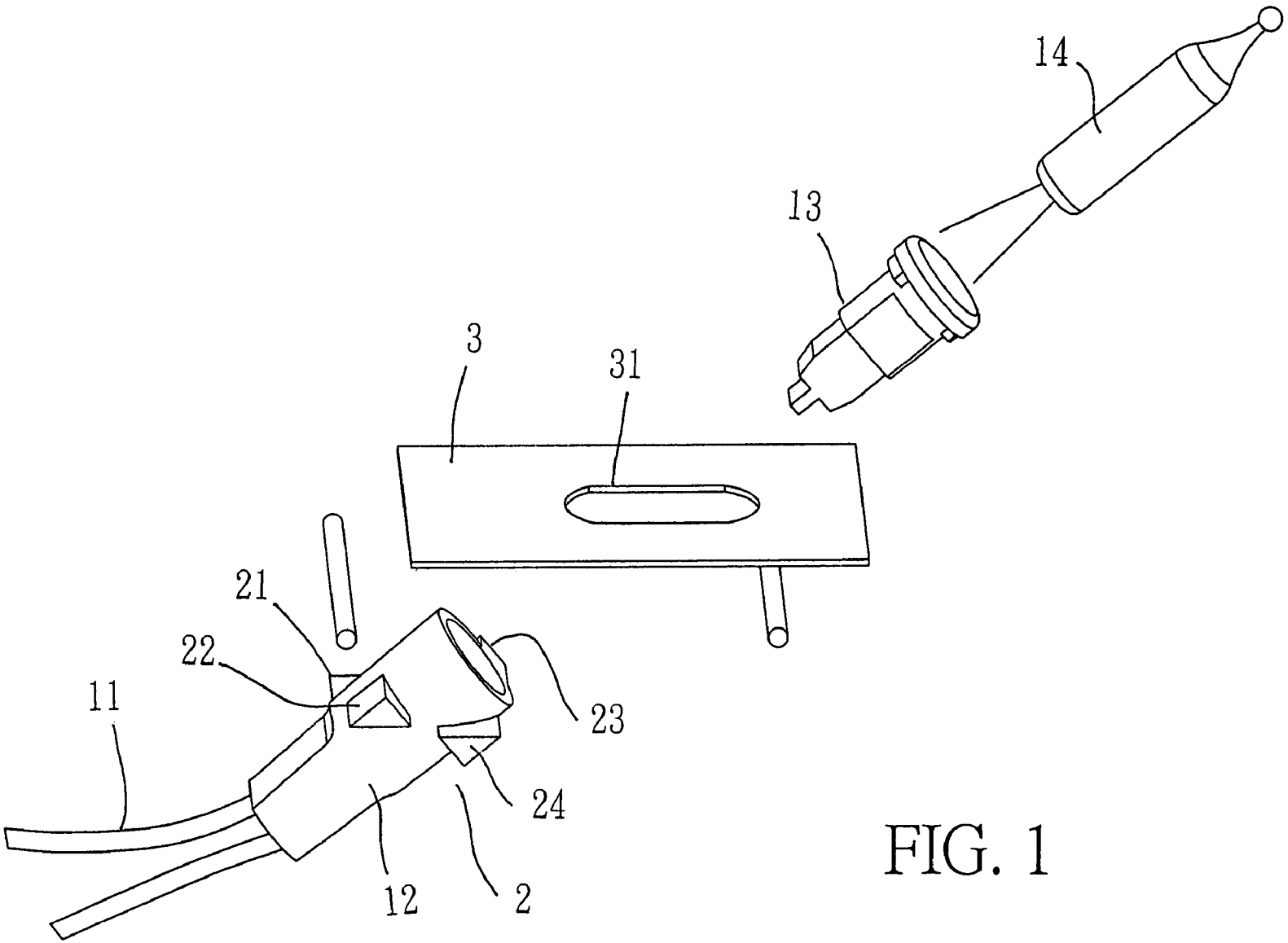
FIG. 1 is a three dimensional view of the lamp socket of the present invention.

Referring to FIG. 1, a unit of the ornamental lamp strings assembly is composed of a lamp string 1, a slanted support 2, and a base plate 3. The lamp string 1 further includes an electric conductor 11, a lamp socket 12, a lamp holder 13, and a lighting element (lamp) 14. The lighting element 14 may be a tungsten incandescent lamp, or a unit or a group of LEDs. The lamp socket 12 is provided with slanted support 12. A circular or elliptical drilled hole 31 is formed on the base plate 3 to engage the slanted support 2 with its inner fringe such that the lamp socket 12 is slantly erected on the base plate 3 forming an acute angle with respect to the longitudinal direction of the lamp string.

Figure 2:
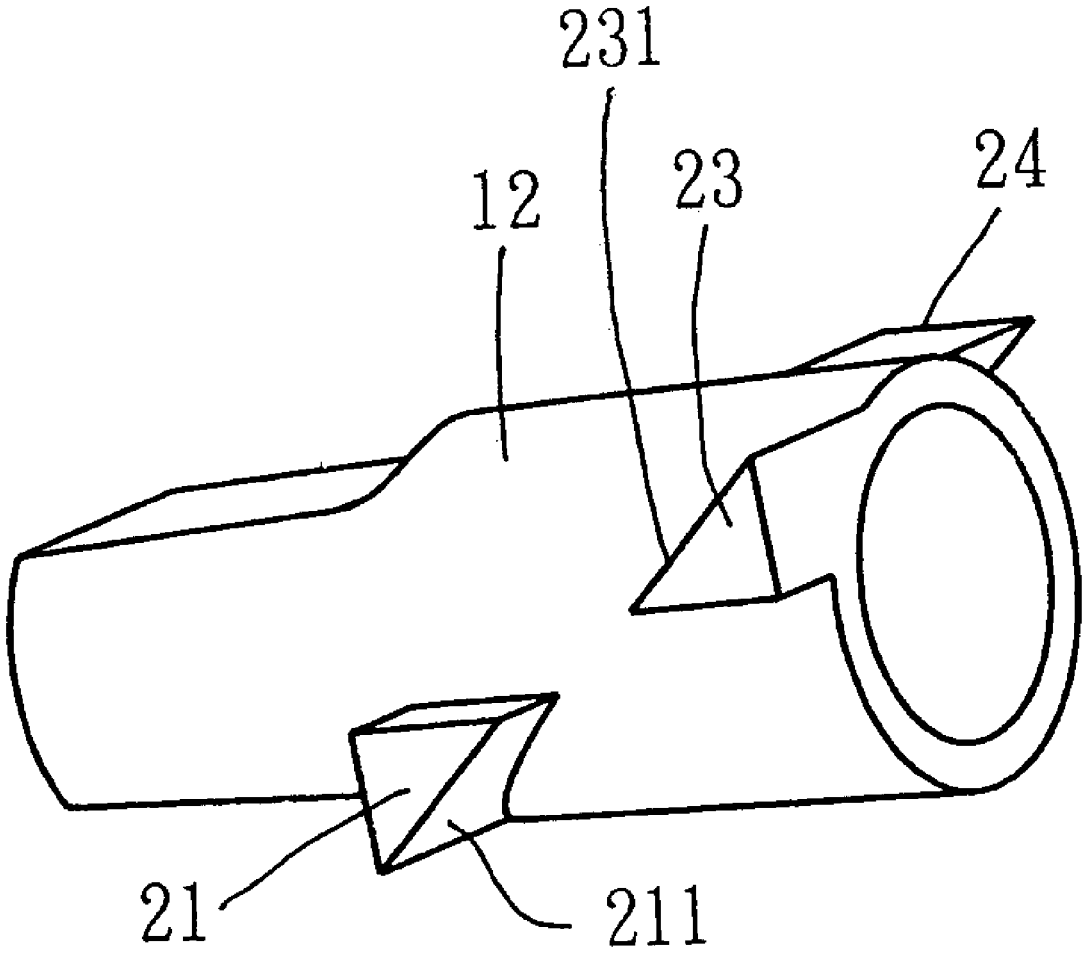
FIG. 2 is a three dimensional view of the lamp socket with its set blocks of the present invention observed from certain direction.
Figure 3:
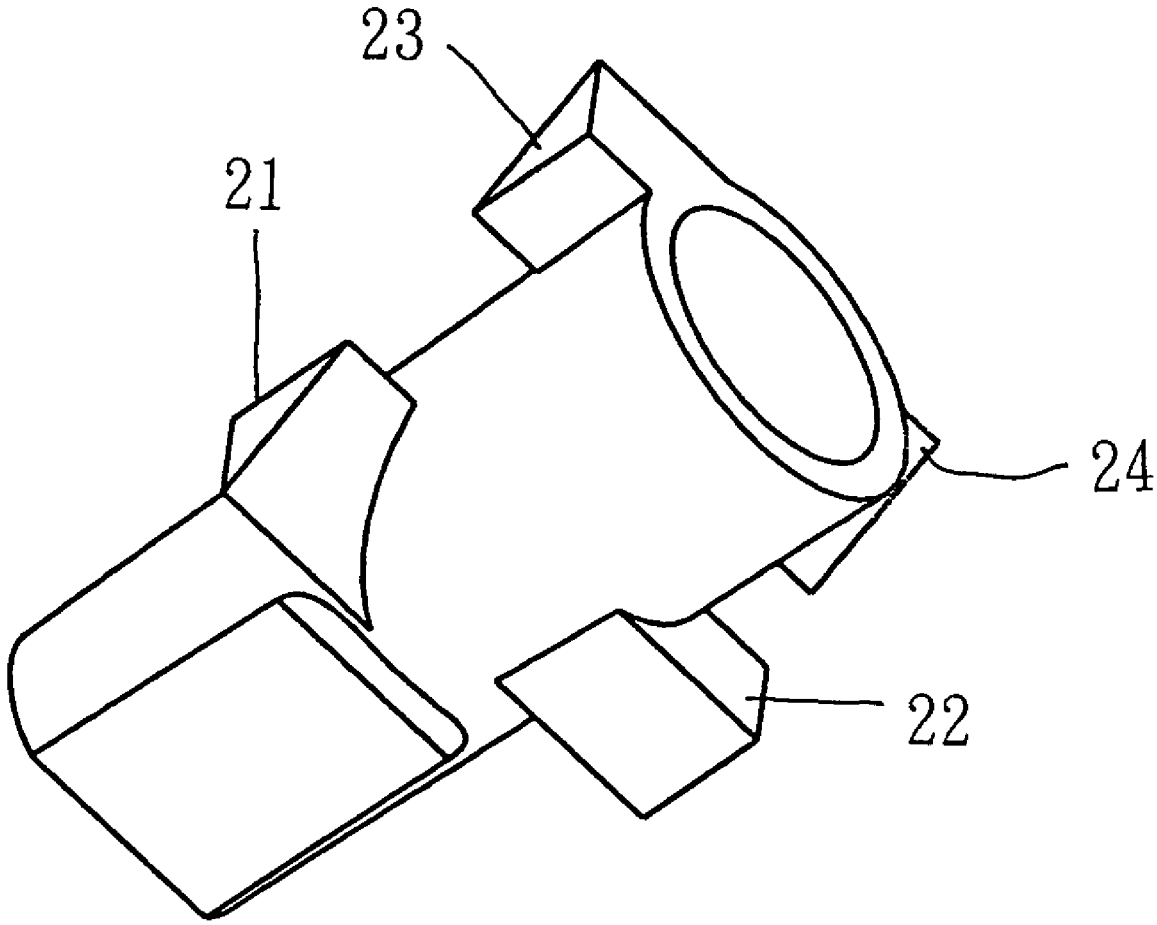
FIG. 3 is a three dimensional view of the lamp socket with its set blocks of the present invention observed from another direction.
Figure 4:
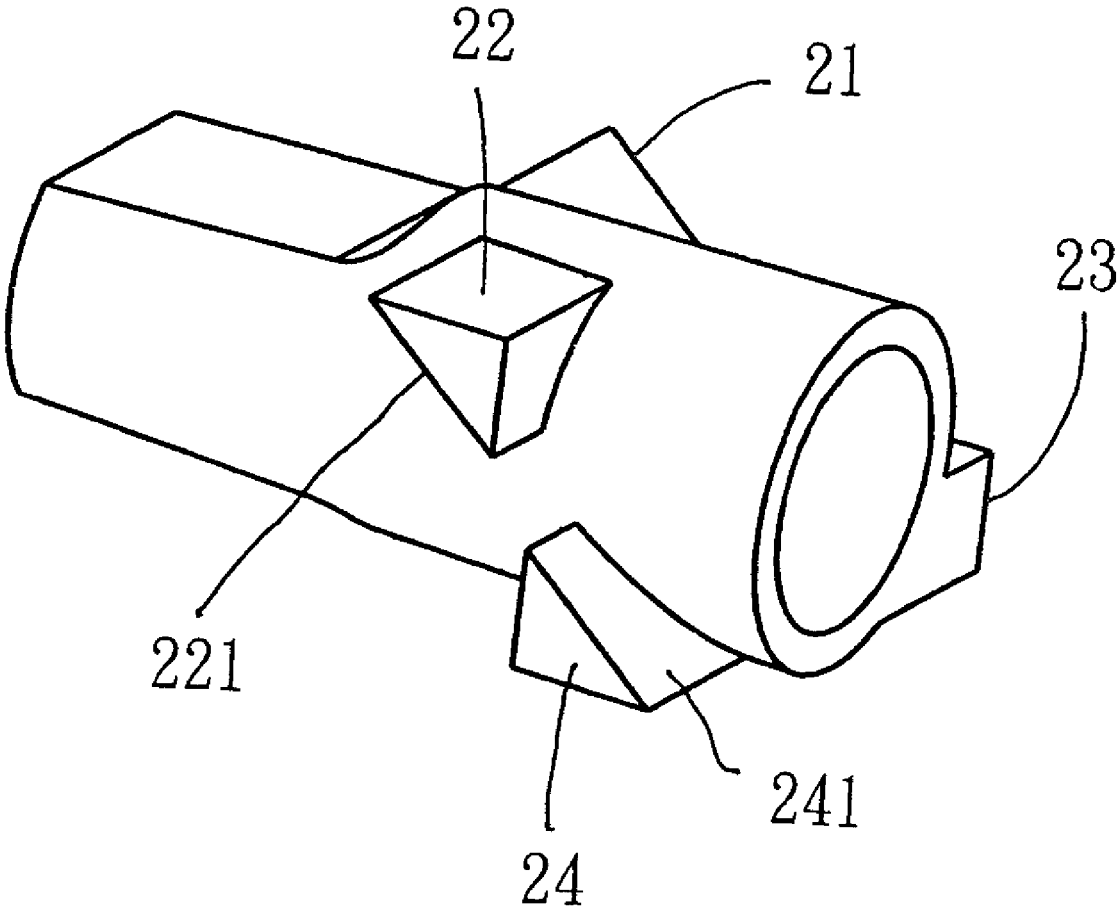
FIG. 4 is a perspective view of the lamp socket with its set blocks before being fastened to its base plate.

Referring to FIG. 2 through FIG. 4, the slanted support 2 has a first, second, third and fourth set blocks 21, 22, 23, and 24. The first and second set blocks 21 and 22 are attached to the middle portion of the lamp socket 12 facing with each other, while the third and fourth set blocks 23 and 24 are attached to the front portion of the lamp socket 12 facing with each other. With this arrangement, the first and third set blocks 21 and 23 are located at the same half side with respect to the longitudinal axis of the lamp socket 12 slantly facing with each other; on the other hand, the second and fourth set blocks 22 and 24 are located at the other half side where the first and third set blocks 21, 23 are located and are also slantly facing with each other. Each of the set blocks 21, 22, 23 and 24 is respectively provided with a sloped surface 211, 221, 231 and 241, where the couple of sloped surfaces 211 and 231, 211 and 241 are slantly facing with each other, and the remaining surfaces of all four set blocks 21, 22, 23 and 24 are associated with the sloped surfaces 211, 221, 231 and 241 to assist the function of the set blocks 21, 22, 23 and 24.

Figure 5:
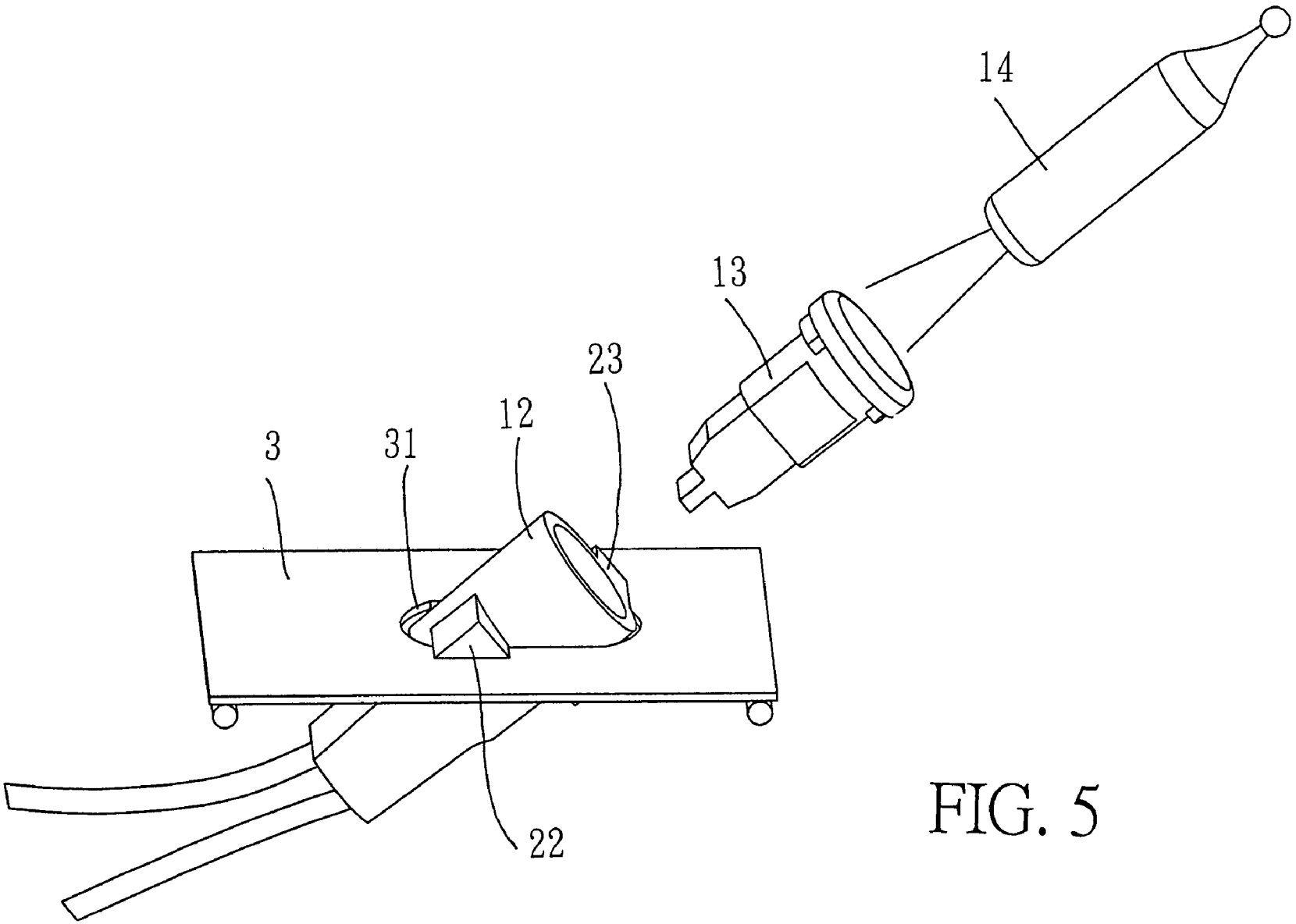
FIG. 5 is an illustrative view demonstrating the process of fastening the lamp socket to its base plate with its set blocks.
Figure 6:
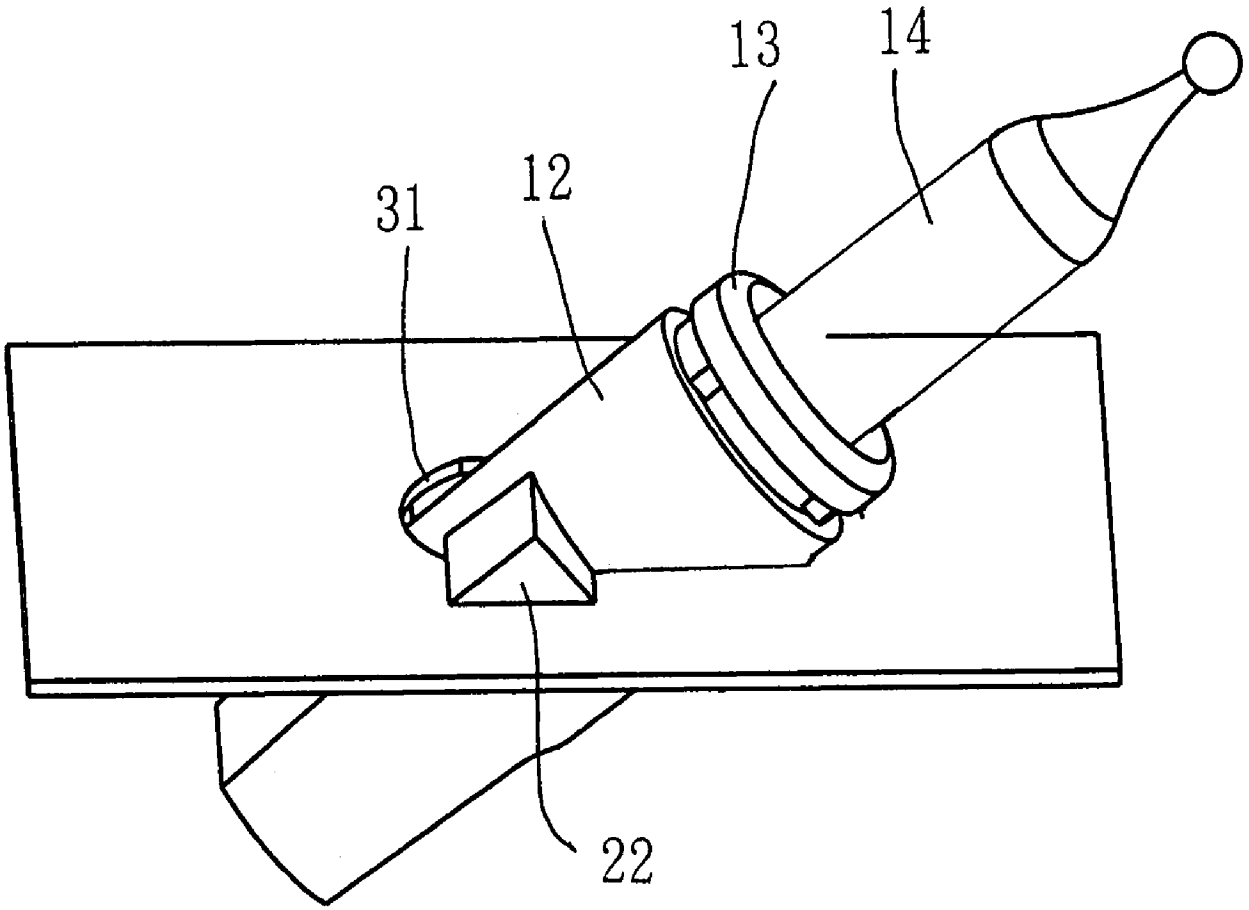
FIG. 6 is a completed assembly view of the lamp on its base plate.

To understand how the lamp socket 12 is fastened to its base plate, please refer to FIGS. 5 and 6. The lamp socket 12 is assembled with its base plate 3 by inserting the lamp socket 12 into the drilled hole 31, and then clogging the first and fourth set blocks 21 and 24 into the drilled hole 31 thus positioned at the rear side of the drilled hole 31, while clogging the second and third set blocks 22 and 23 into the drilled hole 31 and positioned at the front side thereof so that the lamp socket 12 is slantly erected on the base plate, after attaching the lamp holder 13 and the lighting element 14, a slanted ornamental light can be obtained as shown in FIG. 6.

Figure 7:
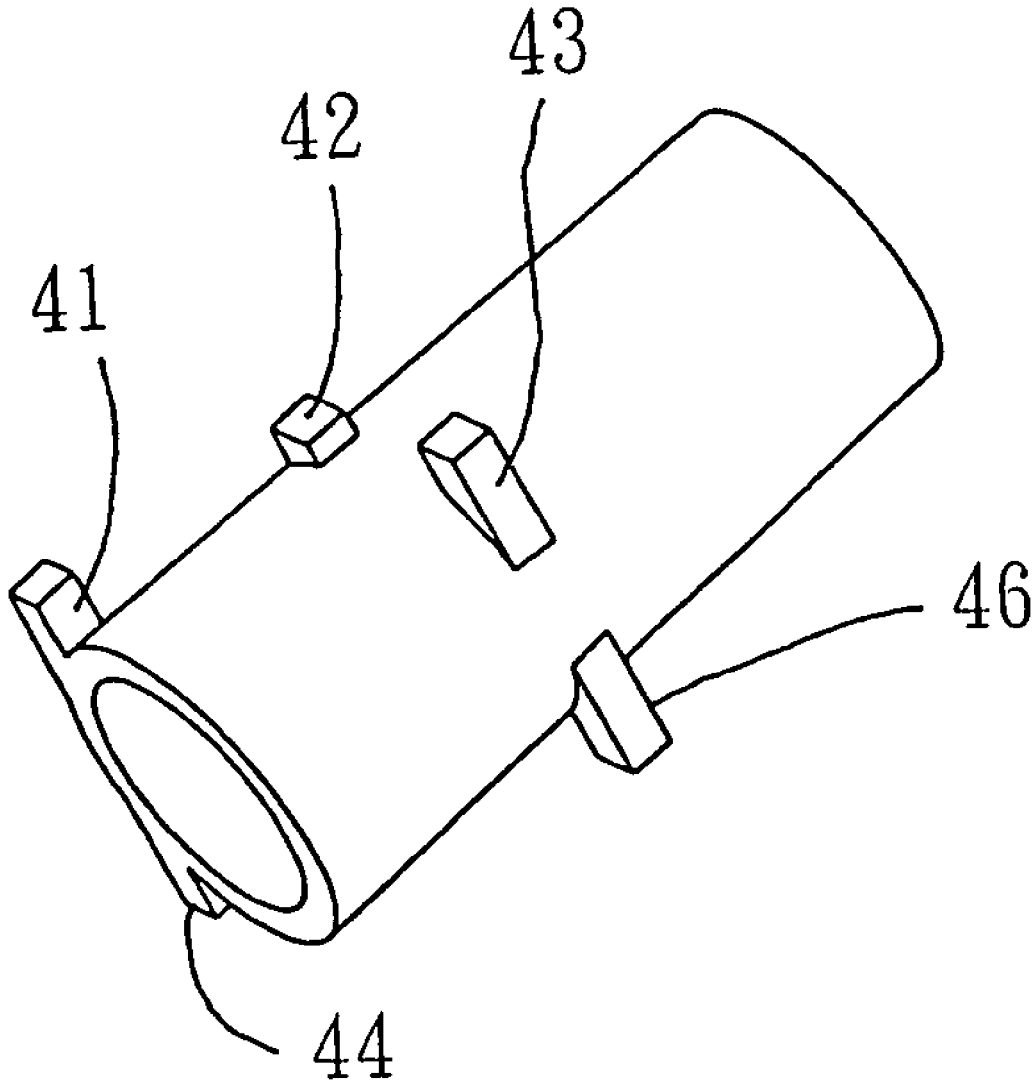
FIG. 7 is a three dimensional view of the lamp socket in the second embodiment.
Figure 8:
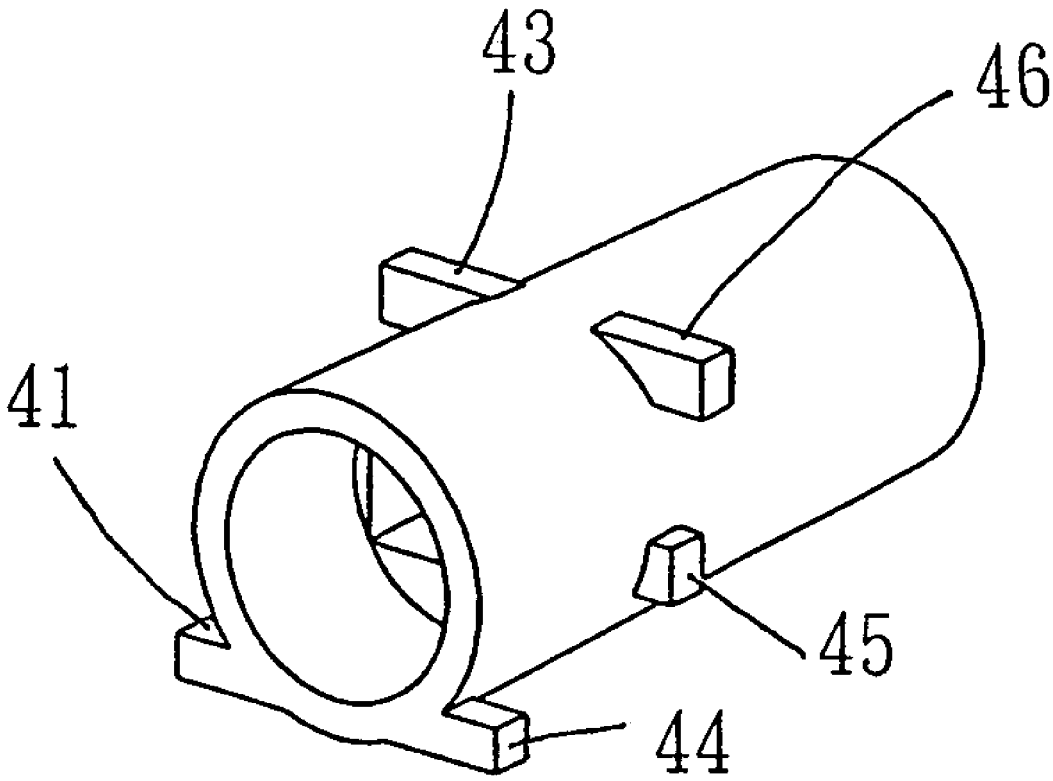
FIG. 8 is the same view as FIG. 7 but observed from another direction.
Figure 9:
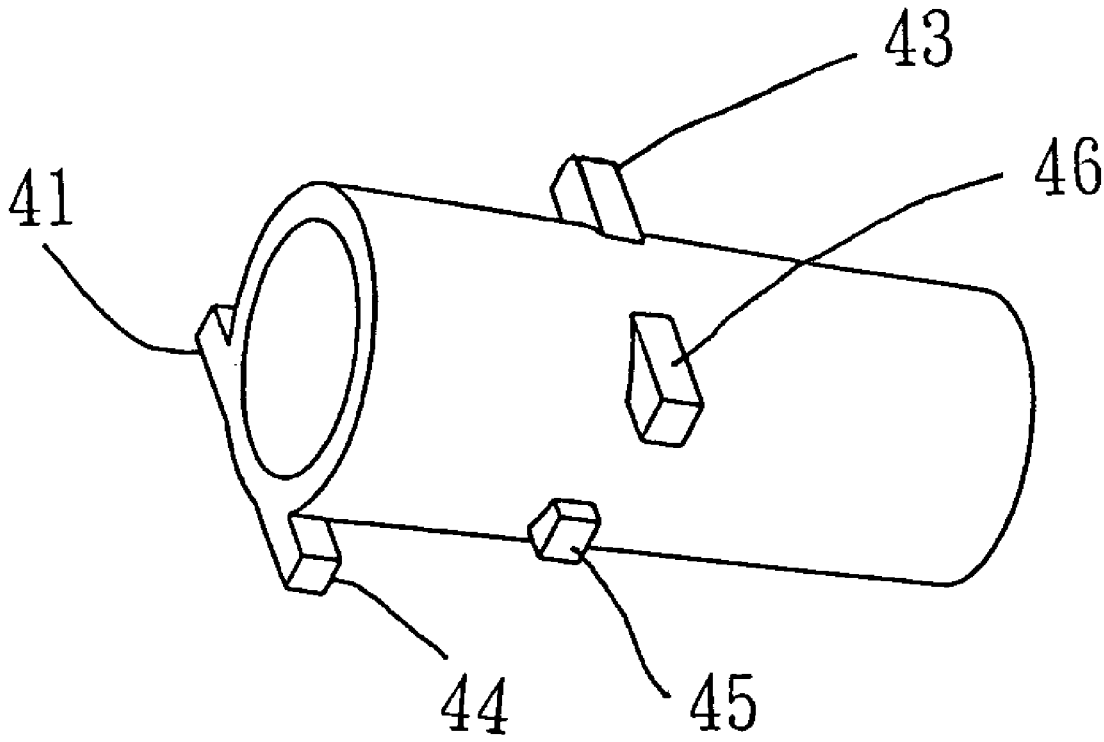
FIG. 9 is the same view as FIG. 8 but observed from another direction.
Figure 10:
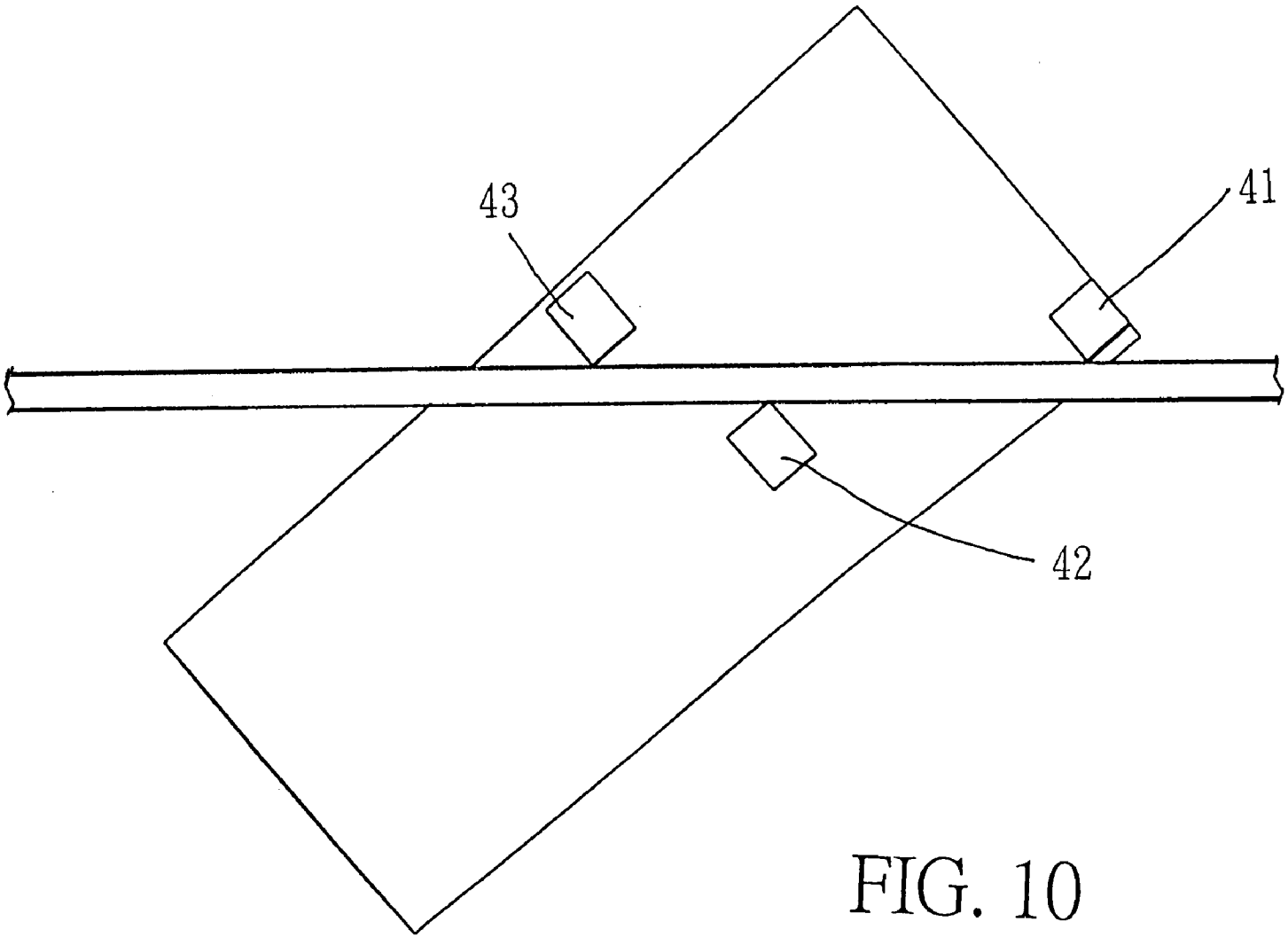
FIG. 10 is a plane view of the completed assembly view of the lamp on its base plate in the second embodiment.

In the second embodiment of the present invention shown in FIG. 7 through FIG. 9, the three points supporting principle is applied to support the lamp socket 12 with set blocks 41, 42, 43, 44, 45 and 46. The set blocks 41 and 43, 43, 44 and 46 are slantly facing with each other with respect to the longitudinal axis of the lamp socket 12. Further to this, the set blocks 42 and 45 are respectively interposed between the midways of the set blocks 41 and 43, 44 and 46, wherein 42 and 41 are located on the same side with respect to the longitudinal axis of the lamp socket 12, while the 44 and 45 are located on the other side of 41 and 43. In this way, a slanted ornamental light can be easily assembled on the base plate or other styled plate as shown in FIG. 10.

Figure 11A:
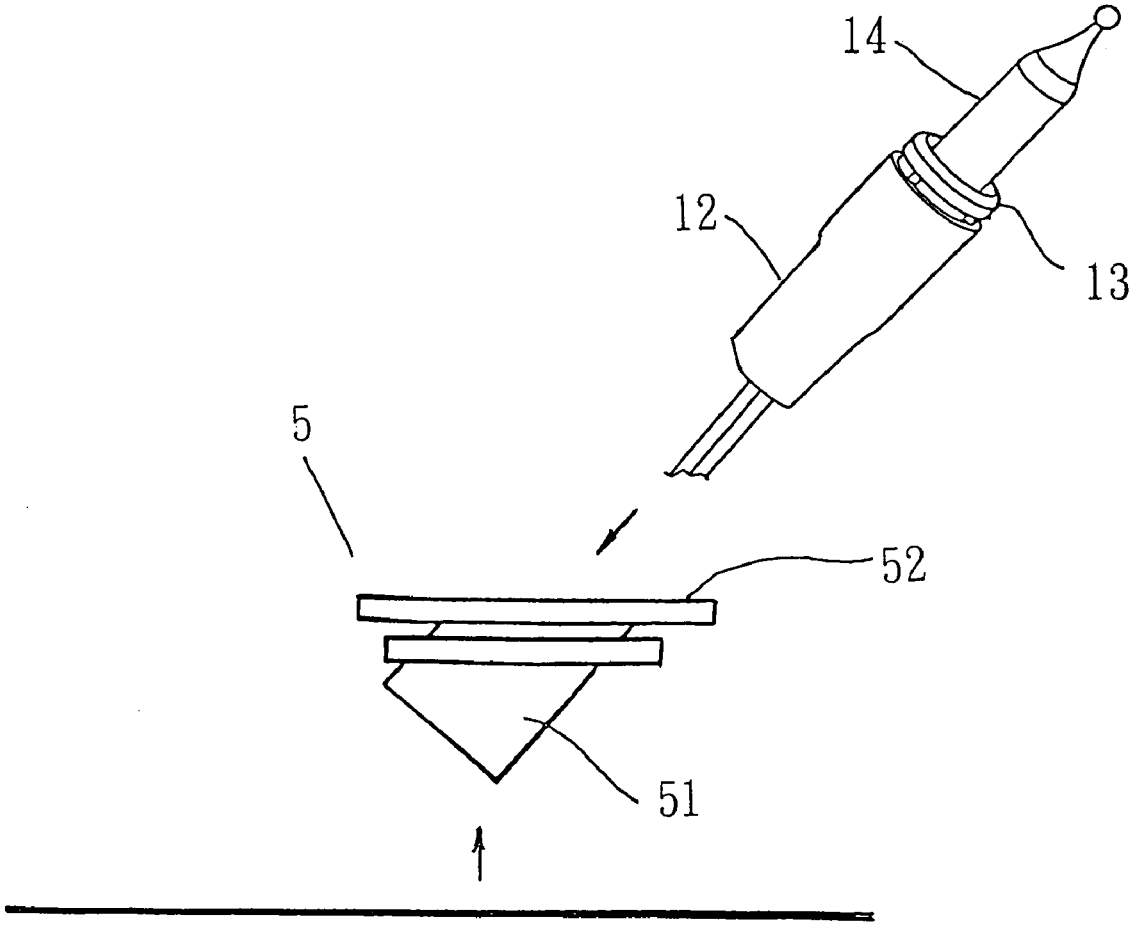
FIG. 11A is an exploded view of the lamp and socket on the base plate in the third embodiment.
Figure 11B:
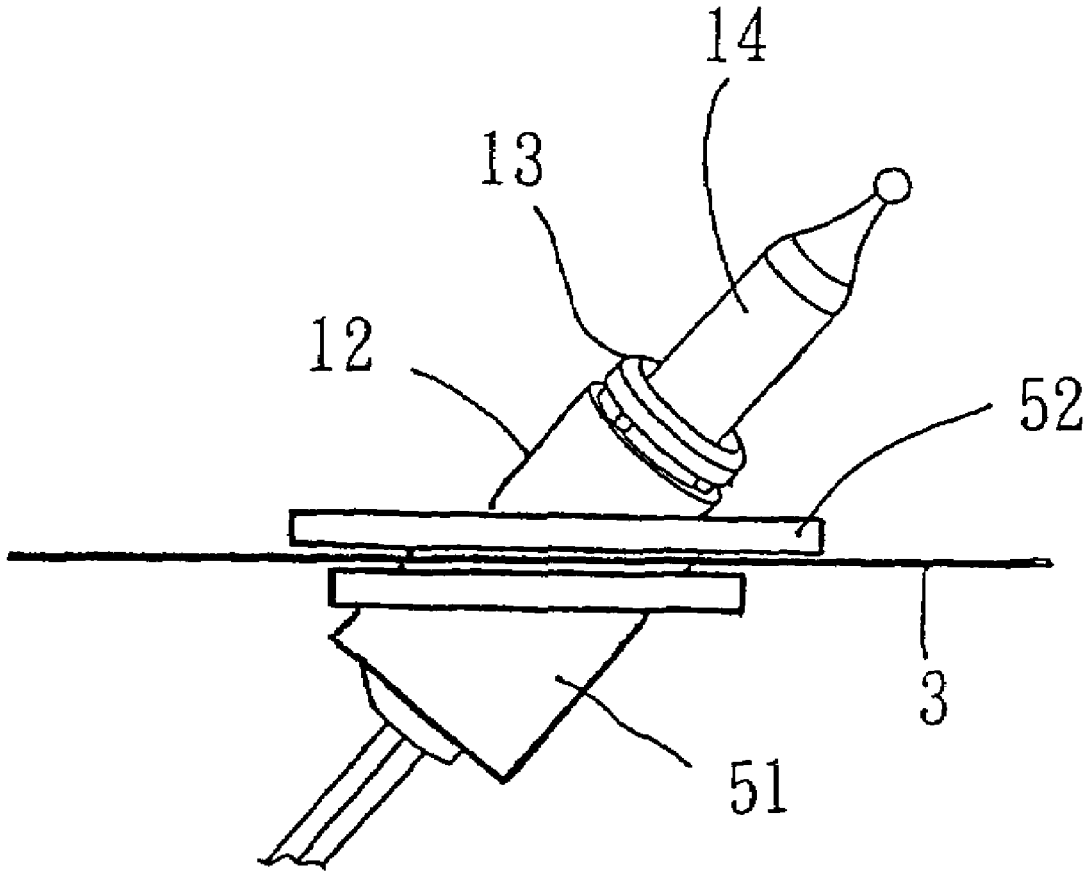
FIG. 11B is a completed assembly view of the lamp and socket on the base plate in the third embodiment.

In the third embodiment of the present invention shown in FIG. 11A and FIG. 11B, the slanted ornamental light can be realized by a slanted support 5 associated with a slanted sleeve 51 having an outer flange formed parallel to the base plate 3 such that the lamp socket 12 is fastened to its base plate 3 by engaging the outer flange of the slanted sleeve 51 with drilled hole. After the lamp holder 13 and the lighting element 14 are installed in order, the slanted ornamental light assembly is completed.

Figure 12:
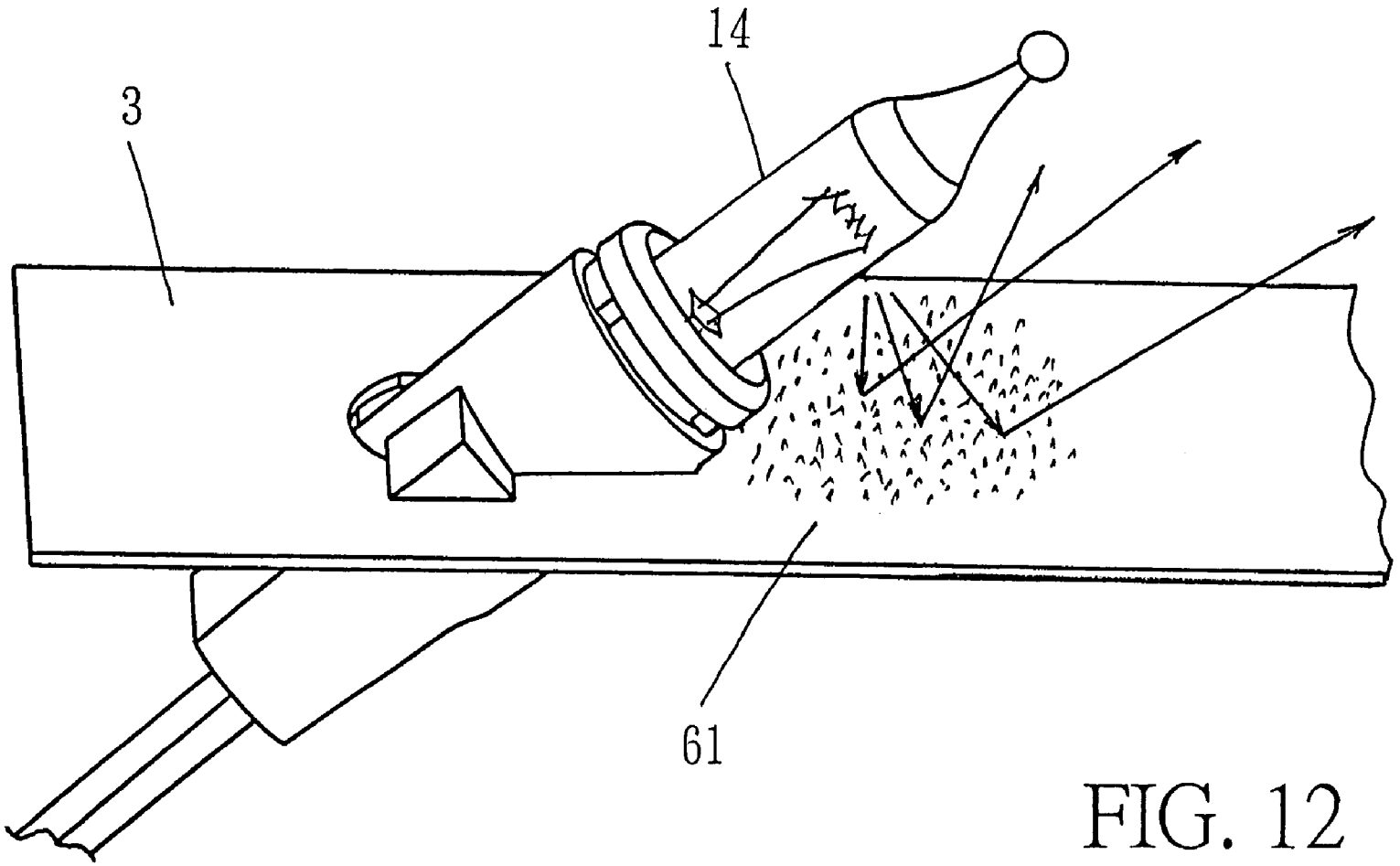
FIG. 12 is the fourth embodiment in order according to the present invention.

In the fourth embodiment of the present invention shown in FIG. 12 a diffused reflector surface 61 is formed on the base plate 3 to serve as a multi-directional reflecting zone apart from a certain distance from the drilled hole 31 and reflect the light beam to various directions.

The same reflector zone reflects light beam in the same direction, the same reflector zone reflects the light beam in unsimilar directions, the different reflector zones reflect the light beam in the same direction, or the different reflector zones reflect the light beam in different directions.

Figure 13:
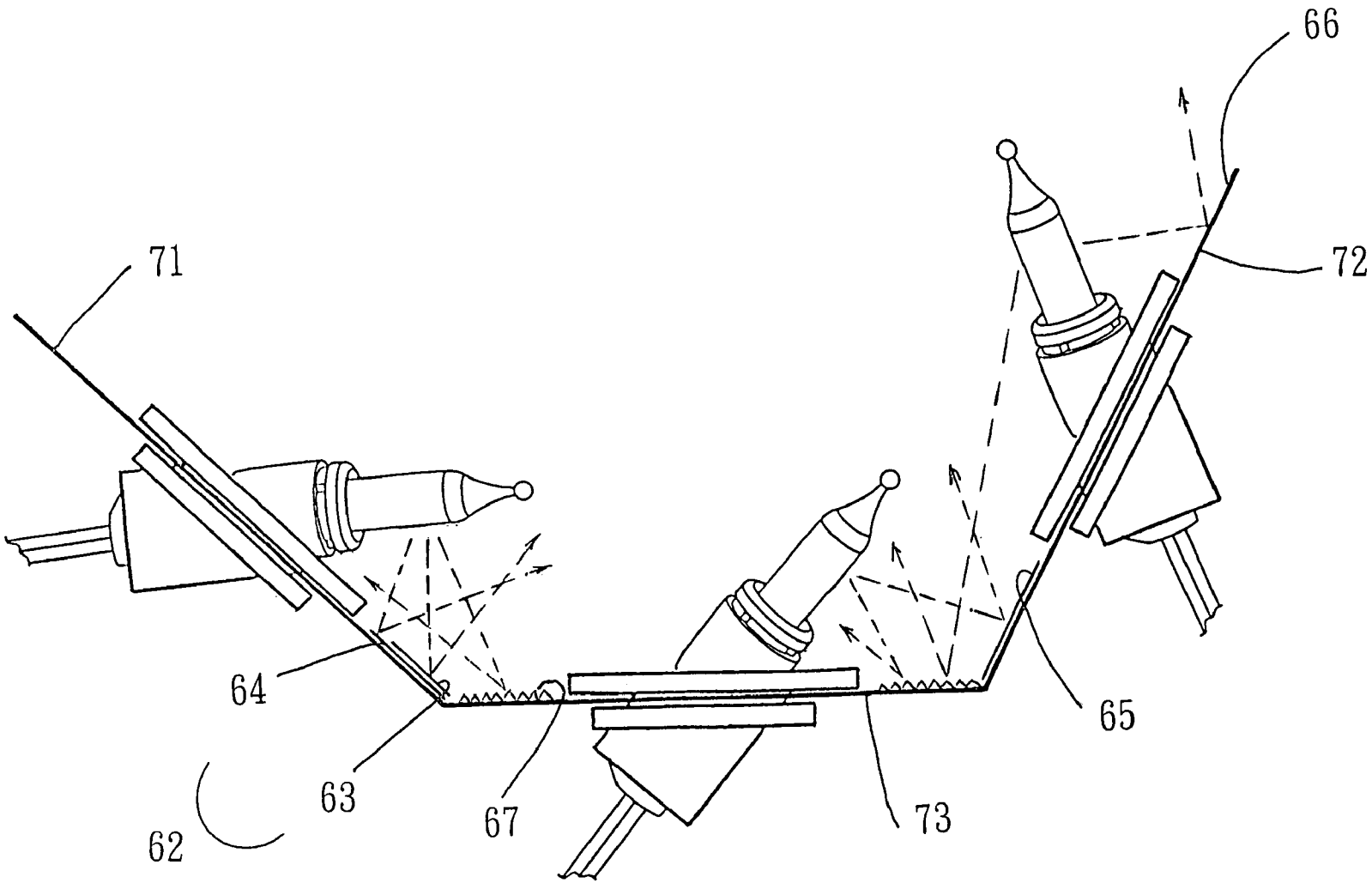
FIG. 13 is the fifth embodiment in order according to the present invention.

In the fifth embodiment of the present invention shown in FIG. 13, the base plate is made of a plurality of sub-plates jointed along a curved route each being equipped with a light source. On the first slanted base plate 71, a multi-layered reflector surface 62 including an upper and lower reflector surfaces 63 and 64 with a clearance sandwiched therebetween is provide. By so the light beam emitted from the light source can make reflection or refraction from the multi-layered reflection surface 62. On the second slanted base plate 72, a single layered reflector surface 65 is provided on a planar reflector surface 66, while a granulated reflector surface 67 is formed on a horizontal base plate 73 located between the first and second slanted base plates 71 and 72 so as to make random reflection of the light beam. All the reflected light beams from the multi-layered and single layered reflection surfaces 62, 65 and the granulated reflector surface 67 are mixed up to enhance the dexterous lighting effect of the ornamental lamp strings assembly.

Figure 14:
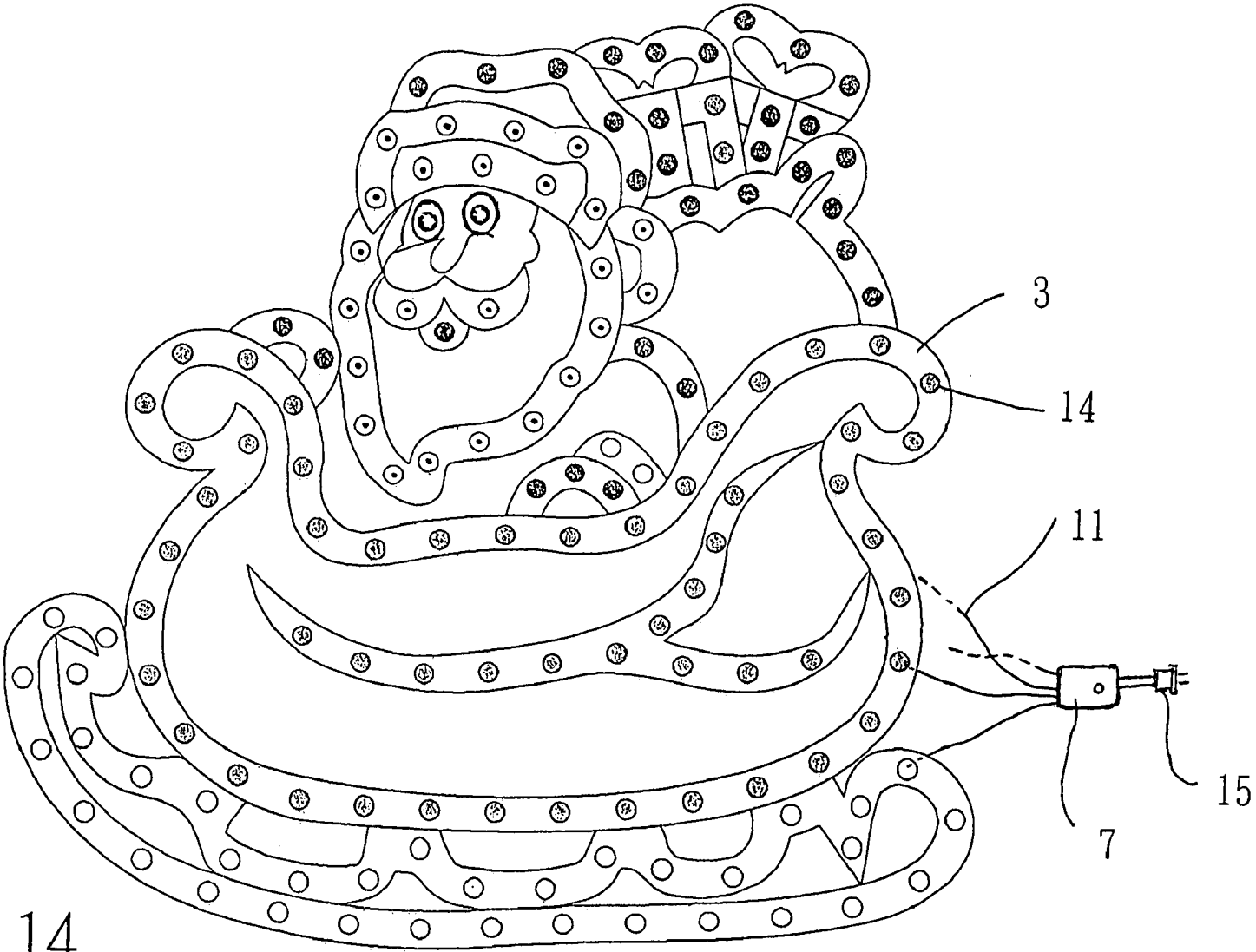
FIG. 14 is the sixth embodiment in order according to the present invention.
Figure 15:
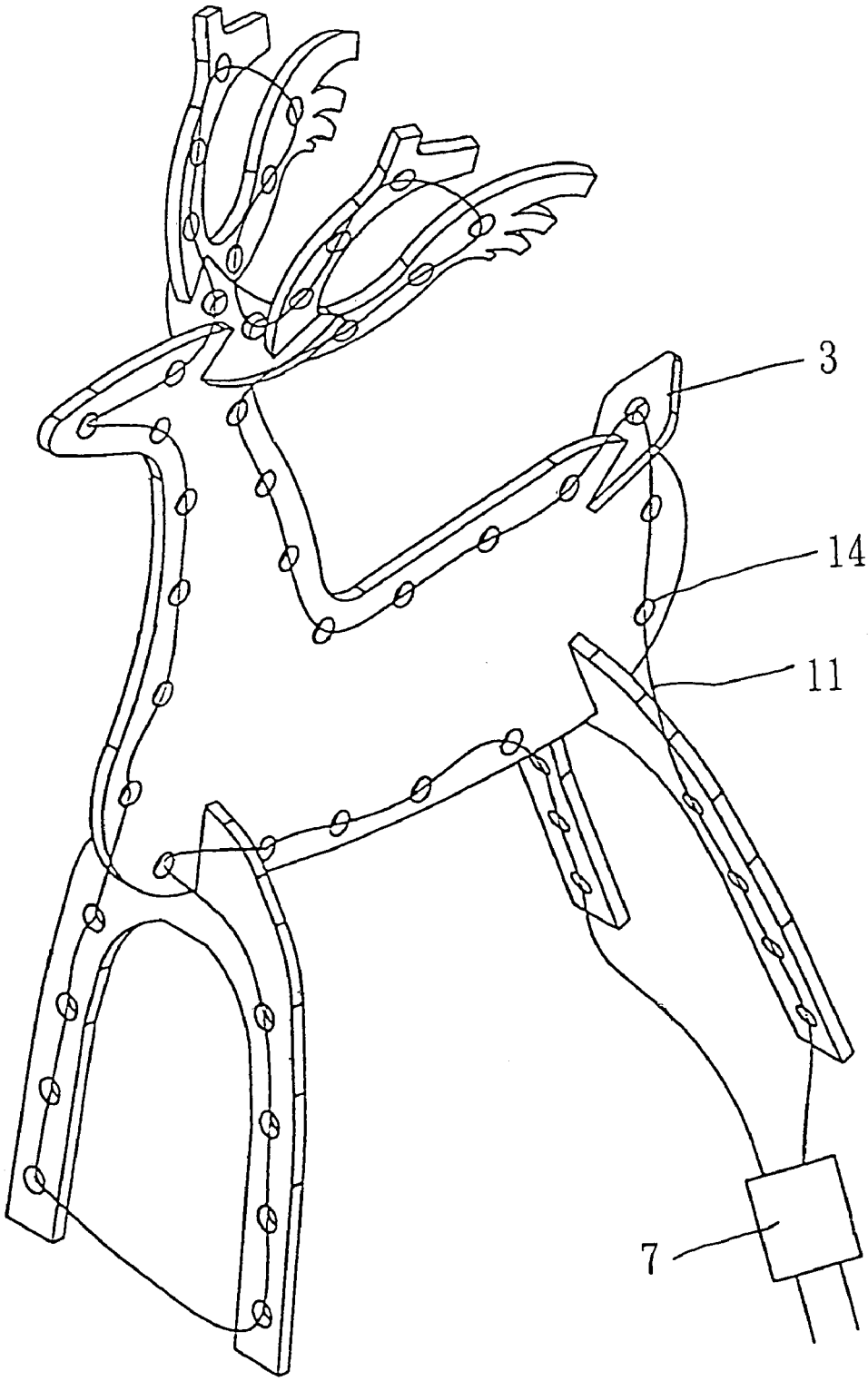
FIG. 15 is the seventh embodiment in order according to the present invention.

In the sixth and seventh embodiments of the present invention shown in FIG. 14 and FIG. 15, the numbers of lamp strings may be configurated into various pictures, characters, or other desired appearances. All the lamp sockets 12, and lamp holders 13 connected in series, parallel, or series-parallel with electric conductors 14 are plugged into the power source with a plug 15. An extra function controller 7 can be added to enrich the lighting mode and effect. The base plate may be formed of various colored materials and its reflector surface may be formed by printing, coating, sputtering, or adhesion.

Figure 16:
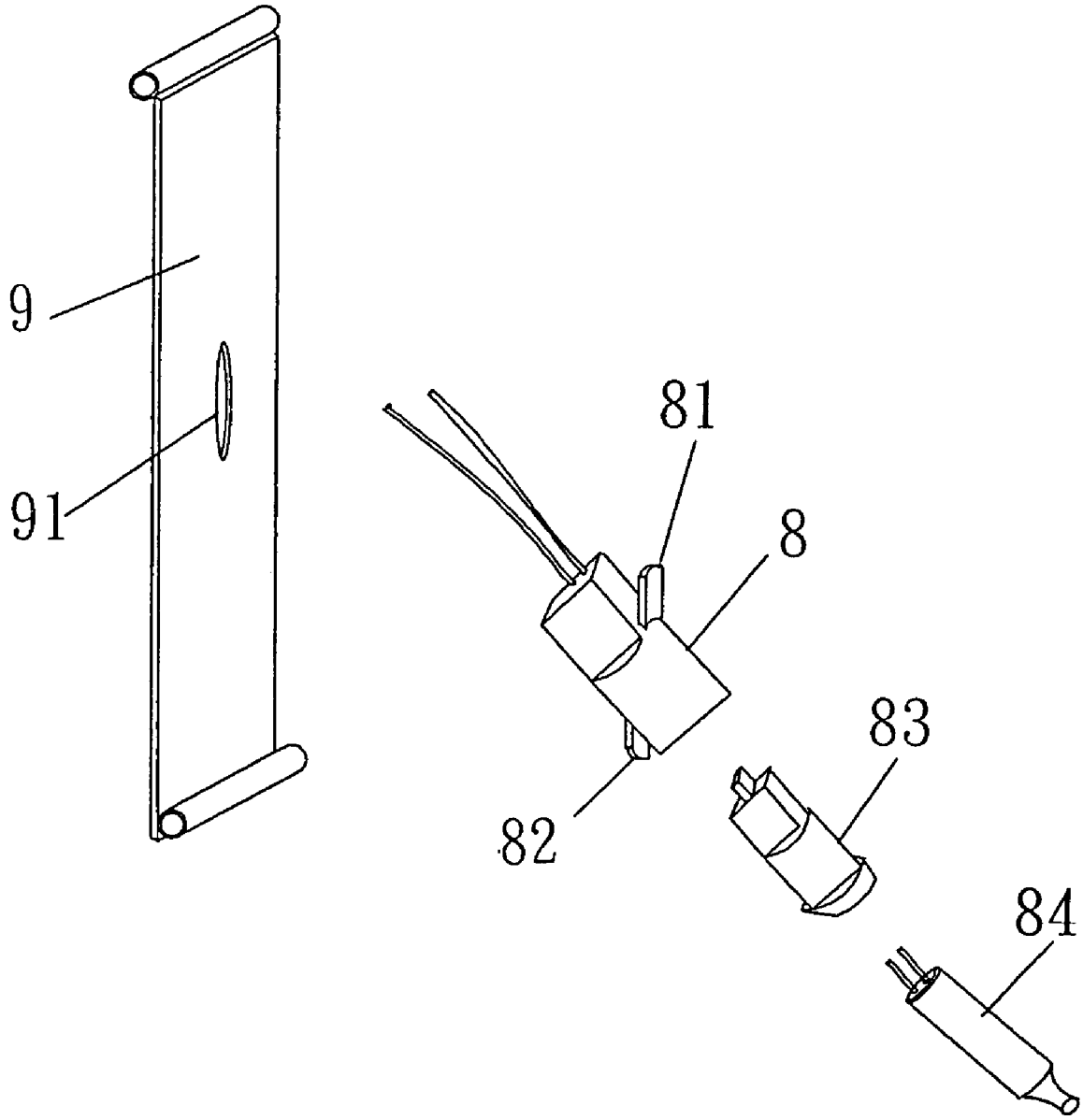
FIG. 16 is a three dimensional exploded view of the eighth embodiment.
Figure 17:
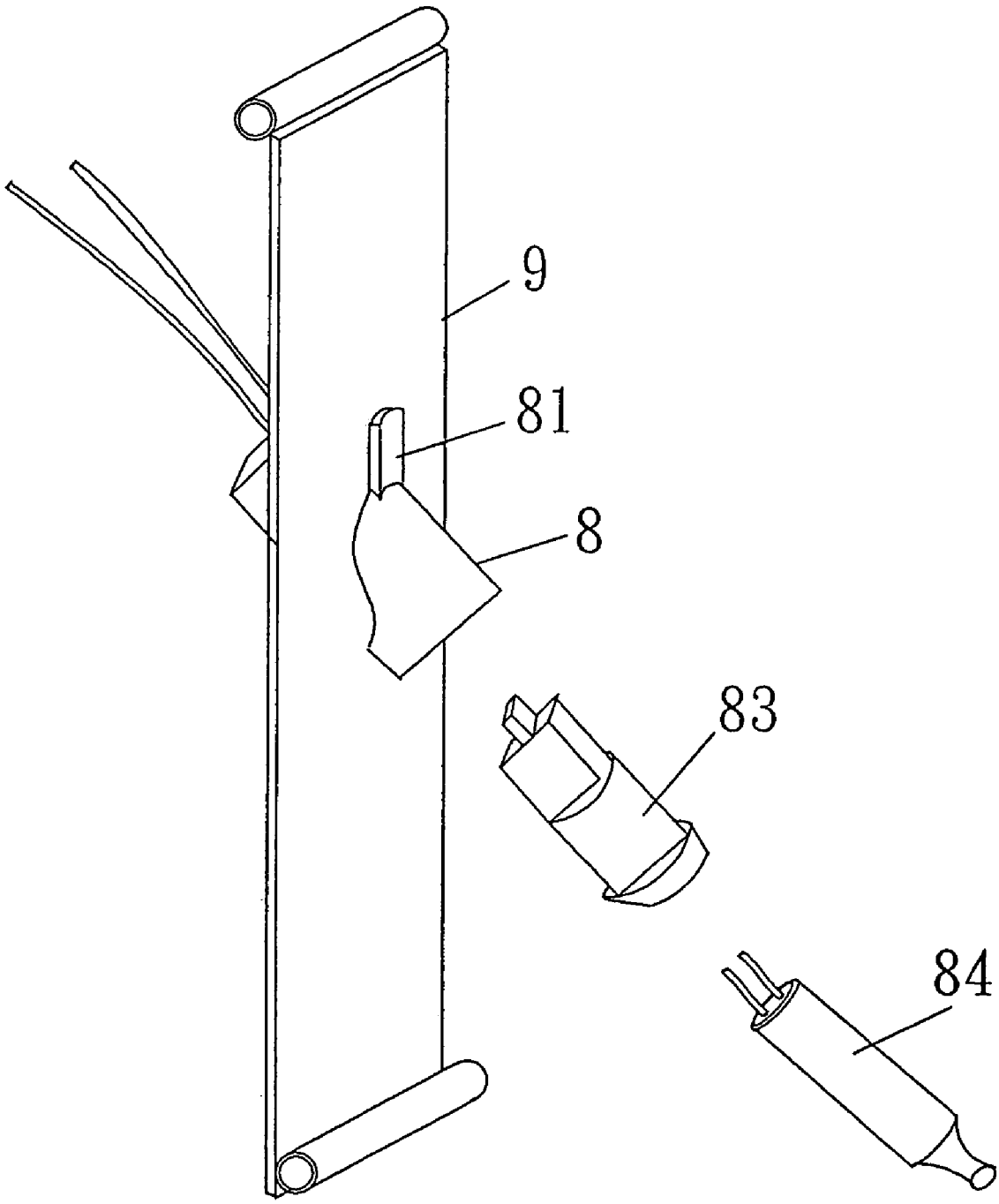
FIG. 17 is a fractional assembly view of FIG. 16.
Figure 18:
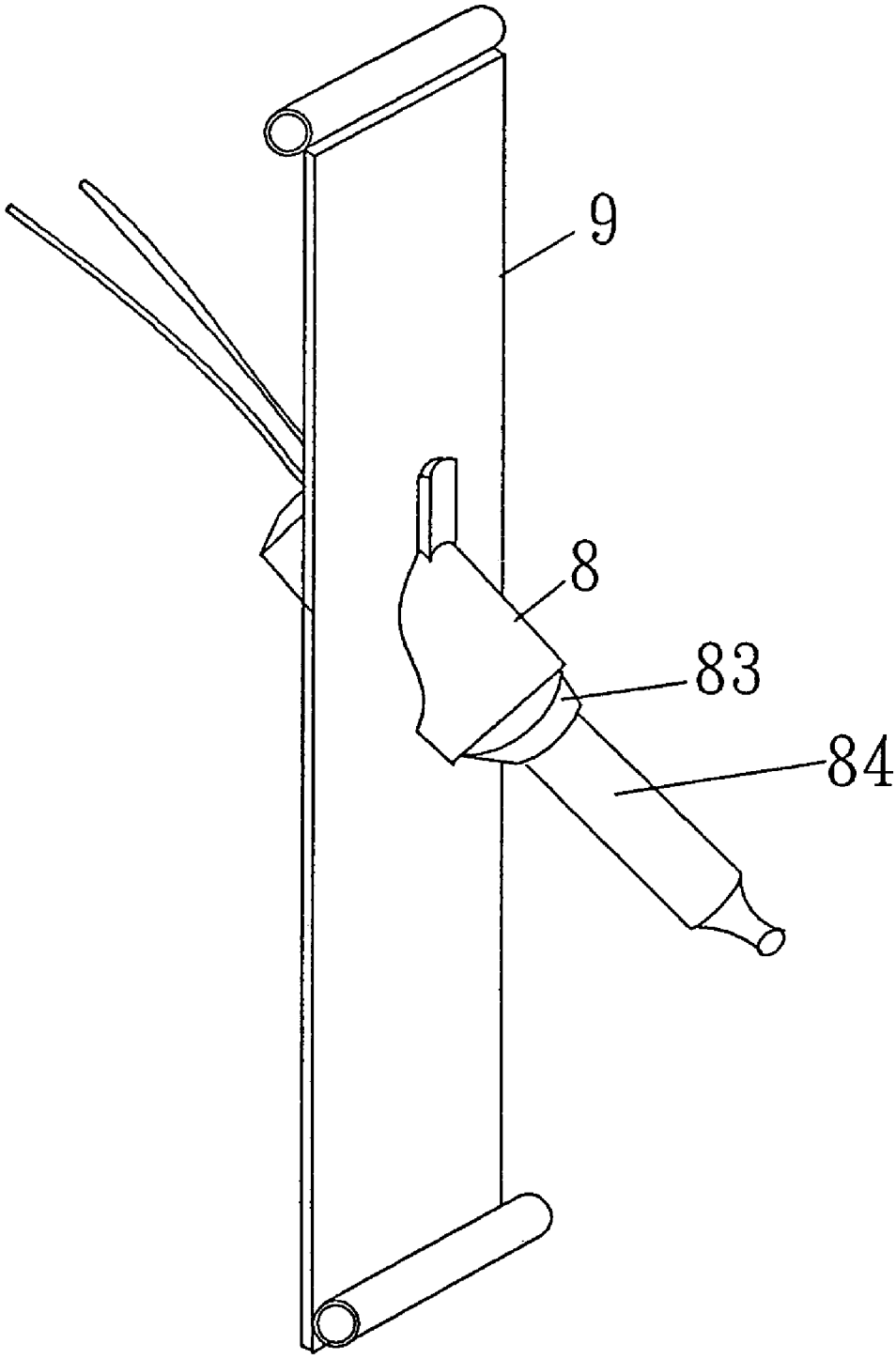
FIG. 18 is an assembly view of FIG. 16.

Besides, as shown in FIG. 16 through FIG. 18, two slanted set blocks 81, 82 forming an acute angle with respect to the longitudinal direction of the lamp socket are provided respectively on the upper and lower ends of the lamp base 8 so as to insert a lamp socket 83 and a lighting element 84 into the lamp base 8 orderly after assembling the lamp base 8 and the base plate 9 with a drilled hole 91 thereby forming another type of slanted illumination style.

The aforementioned set blocks may be formed into various shapes. The styles of lamp socket will be varied even only changing inclination angle of the slanted surface of one of the blocks that leads to enrich the ornamental effect of the lamp string assembly. Besides, selective use of transparent, semi-transparent, and various colored base plates can further enrich the ornamental effect.

The drilled hole prepared on the base plate may be a circular, elliptical or long narrow strip shaped hole, among which the long narrow strip shape is preferable because it remains a clearance allowing lenient selection for the set blocks to clog the lamp sockets in desired styles.

It emerges from the above description that the ornamental lamp strings assembly of the present invention has following advantages:

1. The lamp socket can be slantly fastened to the drilled hole on its base plate in various styles by means of several manipulatively designed set blocks so as to exhibit various lighting effects.

2. Use of specially configurated base plate made of transparent, or semi-transparent, similar or different colored material enables the light strings assembly to further enhance the ornamental lighting effect.

Although the invention has been described in terms of preferred embodiments, it is apparent that numerous variations and modifications may be made without departing from the true spirit and scope thereof, as set forth in the following claims.

What is claimed is:

1. An ornamental lamp strings assembly comprising:

a plurality of lamp strings each with in one string being composed of an electric conductor, a lamp socket, a lamp holder, and a lighting element, wherein said lamp socket is provided with a slanted support; and a base plate having a drilled hole for fastening to said slanted support of the lamp socket with its inner fringe;

wherein, said lamp socket is slantly erected on said base plate forming an acute angle with said base plate.

2. The lamp strings assembly of claim 1, wherein said slanted support has several set blocks affixed to said lamp socket.

3. The lamp strings assembly of claim 1, wherein set blocks are disposed in different positions on the outer surface of said lamp socket.

4. The lamp strings assembly of claim 2, wherein said set blocks are disposed in different positions on the outer surface of said lamp socket.

5. The lamp string assembly of claim 3, wherein two of said set blocks slantly facing with each other are each provided with a sloped surface parallel to the facing direction of said two set blocks.

6. The lamp string assembly of claim 4, wherein two of said set blocks slantly facing with each other are each provided with a sloped surface parallel to the facing direction of said two set blocks.

7. The lamp strings assembly of claim 5, wherein each couple of said sloped surfaces of set blocks are disposed on two sides with respect to the longitudinal direction of said lamp string.

8. The lamp strings assembly of claim 6, wherein each couple of said sloped surfaces of set blocks are disposed on two sides with respect to the longitudinal direction of said lamp string.

9. The lamp strings assembly of claim 5, wherein other surfaces of said set block are associated with said sloped surface to form a complete set block.

10. The lamp strings assembly of claim 6, wherein other surfaces of said set block are associated with said sloped surface to form a complete set block.

11. The lamp strings assembly of claim 5, wherein the three points supporting principle is applied to support said lamp socket with said set blocks.

12. The lamp strings assembly of claim 6, wherein the three points supporting principle is applied to support said lamp socket with said set blocks.

13. The lamp strings assembly of claim 11, wherein one of said set blocks provided according to the three points supporting principle is situated in the midway of the two and is at the same side with one of the two.

14. The lamp strings assembly of claim 12, wherein one of said set blocks provided according to the three points supporting principle is situated in the midway of the two and is at the same side with one of the two.

15. The lamp strings assembly of claim 13, wherein said base plate is slantly positioned on said three points supporting surface.

16. The lamp strings assembly of claim 14, wherein said base plate is slantly positioned on said three points supporting surface.

17. The lamp strings assembly of claim 1, wherein said lighting element is one of a tungsten lamp and LED.

18. The lamp strings assembly of claim 1, wherein said drilled hole formed on the base plate is shaped in a shape that is one of a circular and an elliptical to match the inclined angle of said lamp socket and holder.

19. The lamp strings assembly of claim 1, wherein said base plate and said lighting element are mutually forming an angle so as to reflect the light of said lighting element to multiple directions with said base plate.

20. The lamp strings assembly of claim 1, wherein said lighting elements in said lamp string are arrayed to form one of a picture, a character, and a desired appearance.

21. The lamp strings assembly of claim 19, wherein said lighting elements in said lamp string are arrayed to form one of a picture, a character, and a desired appearance.

22. The lamp strings assembly of claim 1, wherein said base plate is provided with a plurality of reflector surface zones to perform uni-directional reflection.

23. The lamp strings assembly of claim 22, wherein said base plate is provided with a uniform reflector surface to perform mi-directional reflection.

24. The lamp strings assembly of claim 22, wherein said base plate is provided with a same reflector surface zone which performs reflection in different directions.

25. The lamp strings assembly of claim 22, wherein said base plate is provided with unsimilar reflector surface zones which perform uni-directional reflection.

26. The lamp strings assembly of claim 22, wherein said base plate is provided with unsimilar reflector surface zones which perform multi-directional reflection.

27. The lamp string assembly of claim 1, wherein said base plate is provided with one of a single and a multi-layered reflector surface.

28. The lamp string assembly of claim 19, wherein said base plate is provided with one of a single and a multi-layered reflector surface.

29. The lamp strings assembly of claim 1, wherein said base plate is differently colored.

30. The lamp strings assembly of claim 19, wherein said base plate is differently colored.

31. The lamp strings assembly of claim 1, wherein said reflector surface is formed on said base plate by printing, coating, sputtering and adhesion.

32. The lamp strings assembly of claim 19, wherein said reflector surface is formed on said base plate by one of printing, coating, sputtering and adhesion.

33. The lamp strings assembly of claim 1, wherein said base plate is a planar plate.

34. The lamp strings assembly of claim 19, wherein said base plate is a planar plate.

35. The lamp strings assembly of claim 1, wherein said base plate is granulated planar plate.

36. The lamp strings assembly of claim 19, wherein said base plate is granulated planar plate.

37. The lamp string assembly of claim 1, wherein a plurality of base plates are connected three dimensionally to form one multi-faced base plate.

38. The lamp string assembly of claim 19, wherein a plurality of base plates are connected three dimensionally to form one multi-faced base plate.

39. The lamp stings assembly of claim 1, wherein if said base plate is double layered, a clearance is sandwiched between the upper and lower layers.

40. The lamp stings assembly of claim 19, wherein if said base plate is double layered, a clearance is sandwiched between the upper and lower layers.

41. The lamp strings assembly of claim 1, wherein all said lighting elements, lamp sockets and holders are connected in one of series, parallel, and series-parallel with a plurality of electric conductors and then plugged into the power source with a plug.

42. The lamp stings assembly of claim 1, wherein an extra function controller is added to said assembly to enrich the lighting mode and effect.

43. The lamp strings assembly of claim 41, wherein an extra function controller is added to said assembly to enrich the lighting mode and effect.

44. An ornamental lamp string assembly comprising:

a plurality of lamp strings each unit in one string being composed of an electric conductor, a lamp socket, a lamp holder, and a lighting element;

a support for said lamp socket with a slanted flange forming an acute angle with respect to the longitudinal direction of said light string;

a base plate having a drilled hole for fastening to said slanted support of said lamp socket with its inner fringe;

wherein said lamp socket, said support are assembled with said base plate by engaging the flange of said support with said drilled hole, such that said lamp socket associated with its support is slantly erected with an acute angle with respect to the longitudinal direction of said light string.

45. The lamp strings assembly of claim 44, wherein said support for said lamp socket has several set blocks, each of the couple of set blocks has one surface sloped parallel to the facing direction of said two set blocks.

46. The lamp strings assembly of claim 44, wherein a couple of set blocks are each disposed on one side of said lamp socket with respect to the longitudinal axis of said lamp socket.

47. The lamp strings assembly of claim 45, wherein said couple of set blocks are each disposed on one side of said lamp socket with respect to the longitudinal axis of said lamp socket.

48. The lamp strings assembly of claim 44, wherein other surfaces of set block are associated with said sloped surface to form a complete set block.

49. The lamp strings assembly of claim 45, wherein other surfaces of said set block are associated with said sloped surface to form a complete set block.

50. The lamp strings assembly of claim 45, wherein the three point supporting principle is applied to support said lamp socket with said set blocks.

51. The lamp strings assembly of claim 50, wherein one of said set blocks provided according to the three points supporting principle is situated in the midway of the two and is at the same side with one of the two.

52. The lamp strings assembly of claim 51, wherein said base plate is slantly positioned on said three points supporting surface.

53. The lamp strings assembly of claim 44, wherein said lighting element is one of a tungsten lamp and an LED.

54. The lamp strings assembly of claim 44, wherein said drilled hole formed on the base plate is shaped with one of circulator elliptical shape to match the inclined angle of said lamp socket and holder.

55. The lamp strings assembly of claim 44, wherein said base plate and said lighting element are mutually forming an angle so as to reflect the light of said lighting element to multiple directions with said base plate.

56. The lamp strings assembly of claim 44, wherein said lighting elements in said lamp strings are arrayed to form one of a picture, a character, and a desired appearance.

57. The lamp strings assembly of claim 44, wherein said base plate is provided with a plurality of reflector surface zones to perform uni-directional reflection.

58. The lamp strings assembly of claim 44, wherein said base plate is provided with a uniform reflector surface to perform uni-directional reflection.

59. The lamp strings assembly of claim 44, wherein said base plate is provided with a same reflector surface zone which performs reflections in deferent directions.

60. The lamp strings assembly of claim 44, wherein said base plate is provided with dissimilar reflector surface zones which perform uni-directional reflection.

61. The lamp strings assembly of claim 44, wherein said base plate is provided with dissimilar reflector surface zones which perform multi-directional reflection.

62. The lamp strings assembly of claim 44, wherein said base plate is provided with one of a single and multi-layered reflector surface.

63. The lamp strings assembly of claim 44, wherein said base plate is differently colored.

64. The lamp strings assembly of claim 44, wherein said reflector surface is formed on said based plate by one of printing, coating, sputtering and adhesion.

65. The lamp strings assembly of claim 44, wherein said base plate is a planar plate.

66. The lamp strings assembly of claim 44, wherein said base plate is granulated planar plate.

67. The lamp strings assembly of claim 44, wherein a plurality of base plates are connected three dimensionally to form one multi-faced base plate.

68. The lamp strings assembly of claim 44, wherein if said base plate is double layered, a clearance is sandwiched between the upper and lower layers.

69. The lamp strings assembly of claim 44, wherein all said lighting elements, lamp sockets and holders are connected in one of series, parallel, and series-parallel with a plurality of electric conductors and then plugged into the power source with a plug.

70. The lamp assembly of claim 44, wherein an extra function controller is added to said assembly to enrich the lighting mode and effect.

71. The lamp assembly of claim 69, wherein an extra function controller is added to said assembly to enrich the lighting mode and effect.

72. An ornamental lamp strings assembly comprising:

a plurality of lighting elements, lamp sockets and holders connected with electric conductors in one of series, parallel, and series-parallel to form a lamp string and then connected to the power source with, a plug, an extra function controller is added to enrich the lighting mode and effect, a slanted support is provided for each lamp socket; and a base plate having a drilled hole for fastening to said slanted support of said lamp socket with its inner fringe such that said lamp socket associated with said lighting element is slantly erected on said base plate forming an acute angle with said base plate;

wherein said lamp strings assembly is configurated into one of a picture, and a character on one of the same plane and different planes, and in the three dimensional space.

* * * * *